US005349919A

United States Patent [19]

Douglass

[11] Patent Number: 5,349,919

[45] Date of Patent: Sep. 27, 1994

[54] RECREATIONAL BOAT

[75] Inventor: James M. Douglass, Palmetto, Fla.

[73] Assignee: Outboard Marine Corporation, Waukegan, Ill.

[21] Appl. No.: 17,041

[22] Filed: Feb. 12, 1993

[51] Int. Cl.[5] ..... B63B 5/24

[52] U.S. Cl. ..... 114/56; 114/85; 114/179; 114/210; 114/357

[58] Field of Search ..... 114/343, 355, 357, 361, 114/363, 364, 210, 56, 65 R, 85, 362, 182, 179, 271, 291; D12/300, 315, 317, 318

[56] References Cited

U.S. PATENT DOCUMENTS

| | | | |
|---|---|---|---|
| D. 39,252 | 9/1934 | Stratton et al. . | |
| D. 199,768 | 12/1964 | Cole | D12/300 |
| D. 219,118 | 11/1970 | Baker et al. | D71/1 |
| D. 288,087 | 2/1987 | Hegg et al. | D12/315 |
| D. 315,138 | 3/1991 | Simpkins, Sr. et al. | D12/304 |
| D. 322,240 | 12/1991 | Carlson | D12/300 |
| 971,029 | 9/1910 | Fauber | 114/291 |
| 2,370,508 | 2/1945 | Wilkie | 114/179 X |
| 3,790,977 | 2/1974 | Bombardier et al. | 114/357 |
| 3,797,442 | 3/1974 | McRae | 114/197 |
| 4,649,851 | 3/1987 | April | 114/291 X |
| 4,742,795 | 5/1988 | DePrey et al. | 114/343 X |
| 4,821,667 | 4/1989 | Hargett, Sr. | 114/355 |
| 4,827,862 | 5/1989 | Enriquez | 114/273 |
| 4,893,579 | 1/1990 | Kobayashi | 114/363 |
| 4,895,095 | 1/1990 | Potter, Jr. | 114/357 X |

FOREIGN PATENT DOCUMENTS

| | | | |
|---|---|---|---|
| 1231328 | 9/1960 | France | 114/357 |
| 0159998 | 12/1979 | Japan | 114/357 |

OTHER PUBLICATIONS

"From Fantasy to Reality" and Boundless Energy, *Power and Motoryacht Magazine,* Feb. 1993.

Photograph of Regal 400.

Photograph of Sea Ray 370.

1991 vol. 2, No. 2, *Motoryacht International,* pp. 23–25.

Sep. 1991, *Power and Motoryacht,* pp. 90–95.

Feb. 1992, *Power and Motoryacht,* pp. 8, 9, 27, 190, & 191.

*Primary Examiner*—Sherman Basinger

*Attorney, Agent, or Firm*—Michael, Best & Friedrich

[57] ABSTRACT

A recreational boat comprising an aft cockpit, a cabin in front of the cockpit, the cabin having a top surface, side walk ways on the port and starboard sides of the cabin, the walk ways having upper surfaces below the top surface of the cabin, and a forward cockpit having a portion in front of the cabin, the forward cockpit having a floor with an upper surface, the forward cockpit floor upper surface being below the upper surfaces of the walk ways.

49 Claims, 5 Drawing Sheets

RECREATIONAL BOAT

RELATED APPLICATION

Reference is made to Design U.S. Pat. No. 004,759 filed concurrently herewith.

BACKGROUND OF THE INVENTION

The invention relates to a recreational boat, especially a recreational boat made of a composite material such as fiberglass reinforced polystyrene. The boat has a unique forward cockpit near its bow and a novel semi-circular transom at its stern.

It has been known to construct a boat with a forward deck area having a seat across a portion of the aft end of the forward deck in the forward wall of the cabin. However, in these prior art boats, the floor of the forward deck was at the same level as that of side decks leading to it. With the level of the floor of the front deck the same as that of the side decks, any rain or water spray that is collected on the front deck can drain along the side walkways and off the boat. Being on the same level also makes access to the front cockpit relatively easy from the side decks.

Fishing boats in the 20′ to 25′ range of the "walk around" variety are one example of boats of this type. In these boats the front deck and side decks are all below the level of the gunwale. However, with side walkways depressed to the level of a sunken front cockpit, the amount of interior space below the walk ways or side decks in the cabin area is limited.

In addition, it has been known for some time to provide a boat with a substantially vertically transverse planer transom. For example, the Regal 400 and the Sea Ray 370 have transoms in a substantially vertically transverse plane. This type of transom maximizes the area in the aft cockpit, but is not pleasing in adding to the overall appearance of the boat since the rest of the boat is generally curvilinear. It is also known to have a boat with a V-type bottom as seen in transverse cross section for its running surface. This type of bottom allows the boat to plane, but still have a comfortable ride in rough water.

Moreover, it has been know in the art to provide a boat with a displacement or semi-displacement type hull bottom that does not plane, with a curved or semi-circular transom incorporated into the hull piece of the boat.

Other boats having either front decks or aft transoms include those shown in the following patent documents:

| | |
|---|---|
| Des. 93,252 | Stratton |
| Des. 288,087 | Hegg |
| Des. 315,138 | Simpkins |
| Des. 219,118 | Baker |
| Des. 322,240 | Carlson |
| 4,827,862 | Enriquez |

SUMMARY OF THE INVENTION

The invention provides a recreational boat comprising an aft cockpit, a cabin in front of the aft cockpit with the cabin having a top surface, side walk ways on the port and starboard sides of the cabin, the walkways having upper surfaces below the top surface of the cabin, and a forward cockpit having a portion in front of the cabin. The forward cockpit has a floor with an upper surface, with the upper surface of the forward cockpit floor being below the upper surface of the side walkways.

In one embodiment the cabin has a central front portion and the cabin's central front portion extends into the forward cockpit. In another embodiment, the upper surface of the central front portion is covered by a cushion.

In one embodiment the forward cockpit also has a port side wall and a starboard side wall and the port and starboard side walls meet at the forward extreme of the boat. In another embodiment, the boat also has an anchor line that extends through an aperture at the junction of the side walls.

The invention also provides a composite recreational boat comprising a hull having port and starboard side walls with each of the side walls having a top edge, a deck comprising an aft cockpit, a central cabin having a cabin top and port and starboard cabin side walls, a port side deck below the cabin top and between the cabin port side wall and the port hull top edge, a starboard side deck below the cabin top and between the cabin side wall and starboard hull top edge, and a forward cockpit having a floor, the forward cockpit floor being below the port and starboard side decks.

In one embodiment the cabin has a front wall with a middle portion which extends into the forward cockpit. In another embodiment the boat floats on a body of water and the forward cockpit floor comprises a drain communicating directly between the forward cockpit and the body of water.

The invention also provides a composite recreational boat comprising a raised centrally located helm station, a hull having a port side wall and a starboard side wall with each of the side walls having a top edge, an aft cockpit behind and below the helm station, a port narrow side deck and a starboard narrow side deck, the narrow side decks being on either side of and below the helm station and inboard of the port and starboard hull top edges, and a forward cockpit having a floor, with the forward cockpit floor below the side decks and below the hull port and starboard top edges.

In one embodiment, the forward cockpit also has an aft wall which has a central portion, a port side wall and a starboard side wall, and the forward cockpit port side wall is immediately adjacent and inboard of the hull port side wall, and the forward cockpit starboard side wall is immediately adjacent and inboard of the hull starboard side wall.

The invention also provides a composite recreational boat comprising a hull piece, a deck piece and a split line, with the hull piece and the deck piece joined at the split line, the deck piece having an indentation near its forward end with the indentation having a floor and peripheral walls. The indentation floor and peripheral walls being unitary in the deck piece and the peripheral walls completely surrounding the indentation floor.

In one embodiment the indentation floor also comprises a drain directly communicating between the indentation and the body of water in which the boat floats.

In one embodiment the hull piece also comprises a bottom section, the bottom hull section having a port and a starboard bottom wall with the port and starboard bottom wall being in a generally V-relationship as seen in transverse cross-section and each of the port and starboard bottom walls having a top edge, and a central section having a pair of side walls extending upwardly from the top edges of the port and starboard bottom walls, each of the port and starboard side walls also having a top edge which contacts the deck piece at the split line.

In one embodiment the deck piece also comprises a port side and a starboard side and a short downwardly extending outer wall on its periphery along the port side and the starboard side, with the deck outer wall having a bottom edge and the bottom edge contacting the port and starboard hull side wall top edges at the split line.

The invention also provides a composite recreational boat comprising a hull having a port bottom wall and a starboard bottom wall, the port and starboard walls being in a generally V-relationship as seen in transverse cross-section and each of the port and starboard bottom walls having a top edge and an aft edge, port and starboard side walls extending upwardly from the top edges of the port and starboard bottom wall, each of the port and starboard side walls having an aft edge, and a transom wall having a top portion and a bottom portion, the transom wall bottom portion being substantially vertical and extending transversely between the aft edges of the port and starboard bottom walls and the transom wall top portion being substantially vertical and extending transversely in a substantially semi-circular arc between the port and starboard side walls.

In one embodiment, the transom wall also has an aft swim platform extending rearwardly from intermediate the transom top portion and the transom bottom portion.

In one embodiment, the transom wall bottom portion extends transversely between the aft edges of the port and starboard bottom walls in a substantially shallow arc.

The invention also provides a composite recreational boat comprising a hull piece, a deck piece and a split line with the hull piece and the deck piece joined at the split line. The hull piece comprises a port bottom wall and a starboard bottom wall, the bottom walls being in a generally V-relationship as seen in transverse cross-section with each of the bottom walls having an aft edge. The hull piece also comprises a substantially vertical hull transom wall extending transversely between the bottom wall aft edges. The deck piece also comprises a port and a starboard side wall with the port and starboard side walls having aft edges and a substantially vertical deck transom wall extending between the deck side walls in a substantially semi-circular arc.

Other features and advantages of the invention will become apparent to those skilled in the art upon review of the following detailed description, claims, and drawings.

Figure 1:
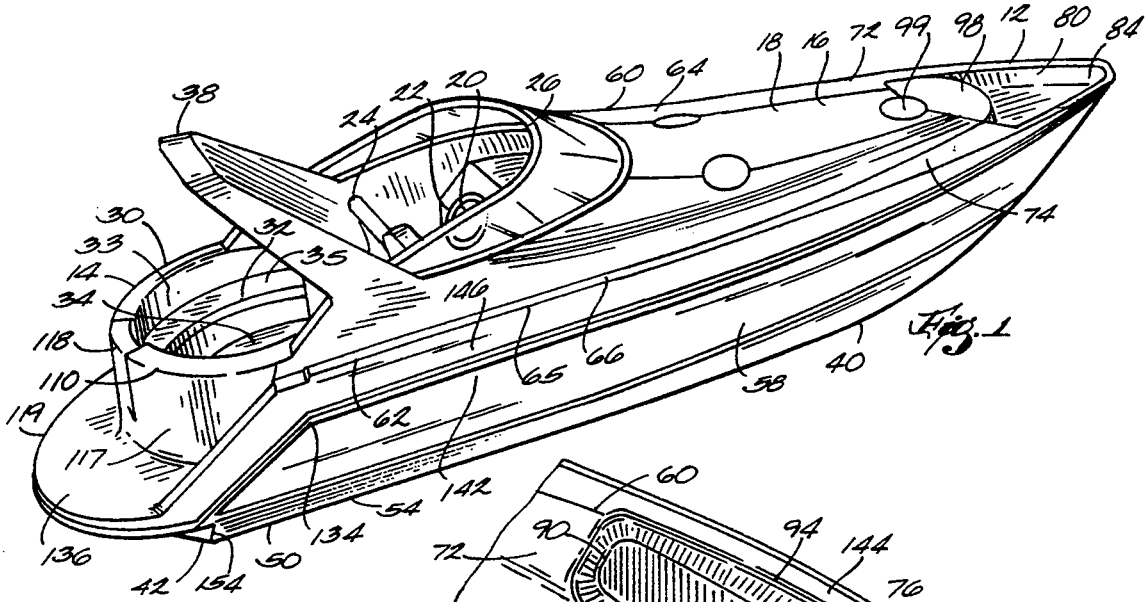
FIG. 1 is a top and rear perspective view of a boat embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a recreational boat 10 having one embodiment of the unique features of the invention. The boat illustrated is primarily made of a composite of fiberglass reinforced polystyrene material. However, the invention could be practiced in conjunction with other types of materials, including other types of composite materials.

Figure 4:
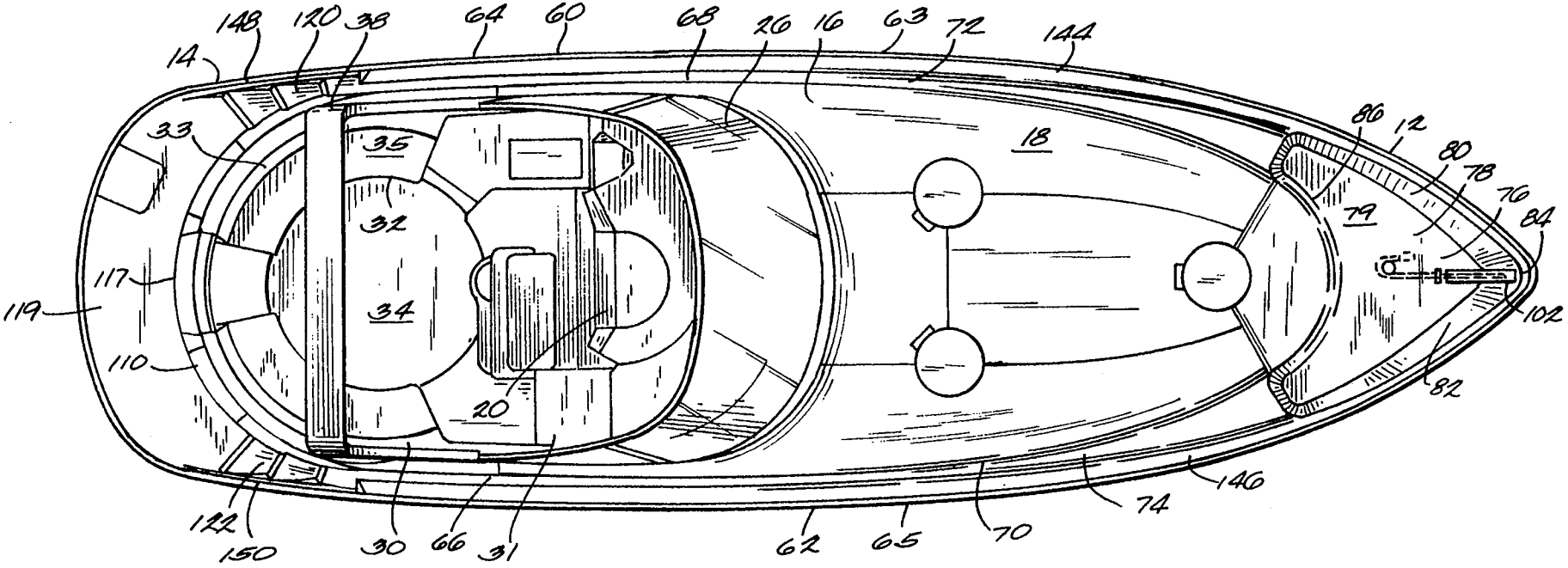
FIG. 4 is a top plan view of a boat embodying the invention.

The boat illustrated, especially as seen in FIGS. 1 and 4, has a forward or bow section 12 and an aft or stern section 14. The boat also has a centrally located cabin area 16 which is substantially covered by a cabin top 18. On the aft side of and raised from the cabin is a helm station 20 comprising a steering wheel 22 and a seat 24 and control levers (not shown) to operate the propulsion means for the boat (also not shown). Immediately in front of and also on the sides of the helm station is a windshield 26 to protect the operator from wind and spray as the boat 10 moves forwardly through the body of water in which it is to be used.

Immediately behind the helm station is an aft cockpit 30. The aft cockpit comprises an aft seat 32 having a seat back 33 and a seat bench 35. As can be seen in FIG. 4, in a preferred embodiment the aft seat is substantially semi-circular and immediately inside of the aft outer periphery of the aft cockpit. The aft cockpit 30 also comprises a floor 34 below the seat.

As seen in FIG. 4, beside the helm station 20 and immediately in front of the aft cockpit 30 is a companionway 31 from the aft cockpit to the cabin 16. The companionway may include a plurality of steps descending from the aft cockpit level down to the cabin sole level (not shown).

Above the cockpit is an inverted U-shaped radar arch 38 which extends upwardly and rearwardly from said helm station and which adds to the styling of the boat and can also act as a platform for a radar (not shown).

Figure 6:
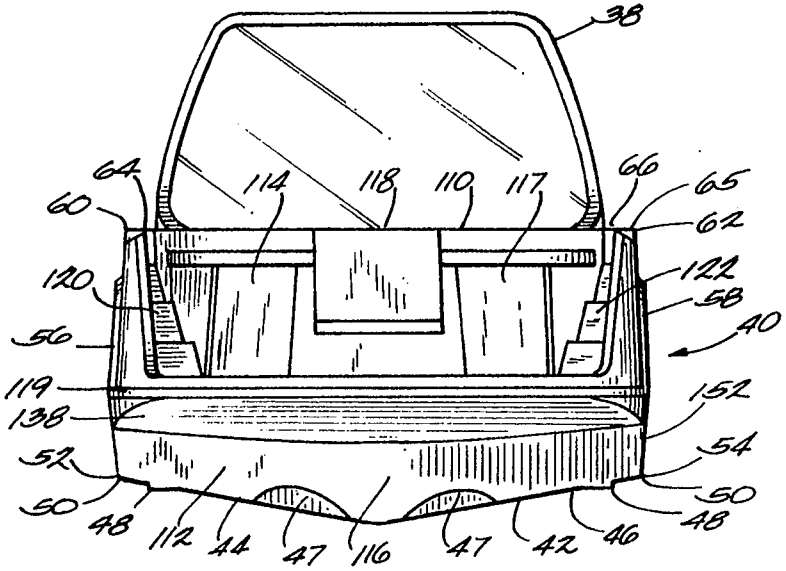
FIG. 6 is a rear elevational view of a boat embodying the invention.

As seen in FIG. 6, the boat also comprises a hull 40 substantially along its entire length. The hull comprises a running surface 42 which is essentially the portion of the hull that is in contact with the water as the boat is propelled forwardly through the water. The running surface comprises a hull port bottom section 44 and a hull starboard bottom section 46. As can be seen in FIG. 6, the port and starboard bottom sections create a V or are in a generally V relationship as seen in transverse cross section. In addition, each of the port and starboard bottom sections may have a propeller pocket 47 and one or more lifting strakes 48 and a chine 50 at the outer edge 52 of the port bottom section and a chine 50 at the outer edge 54 of the starboard bottom section. The V type bottom allows the boat to plane and also cut neatly through wavy water.

Extending upwardly from the outer edge 52 of the port bottom section is a hull port side section 56, and extending upwardly from the outer edge 54 of the starboard hull bottom section is the starboard hull side section 58.

The port hull side section has a top edge 60 which runs substantially along the length of the boat. Likewise, the starboard hull side section has a top edge 62 which also runs substantially along the length of the boat. Each of these top edges also forms the outer edge 63 and 65 respectively of a port 64 and starboard 66 gunnel.

Figure 2:
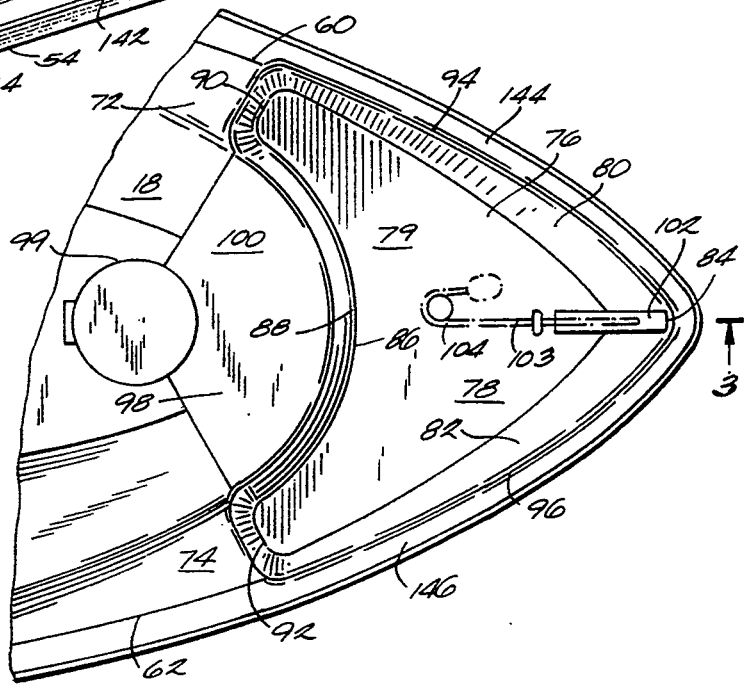
FIG. 2 is a top plan view of the forward portion of a boat of FIG. 1 slowing the forward cockpit.

As best seen in FIGS. 4 and 6, the port gunnel 64 extends between the port hull top edge 60 and a port cabin wall 68 in the mid section of the boat. In similar fashion, the starboard gunnel 66 extends from the starboard hull top edge 62 inboard to a starboard cabin wall 70 along the midsection of the boat. Accordingly, a narrow port side deck or walk way or walk around 72 is formed on the port side and a similar starboard side deck, walk way or walk around 74 is formed on the starboard side. The port 72 and starboard 74 walk ways extend along most of the length of the cabin, aft beside the helm station 20 and also for a short distance on the outsides of the aft cockpit 30 at a location above the aft cockpit floor 34. These walk ways allow access from the aft cockpit to a forward cockpit 76. (See FIG. 2). Below the walk ways 72 and 74 and inboard of the hull side walls 56 and 58 is additional cabin space 16 in the portion beside the cabin top 18.

Figure 3:
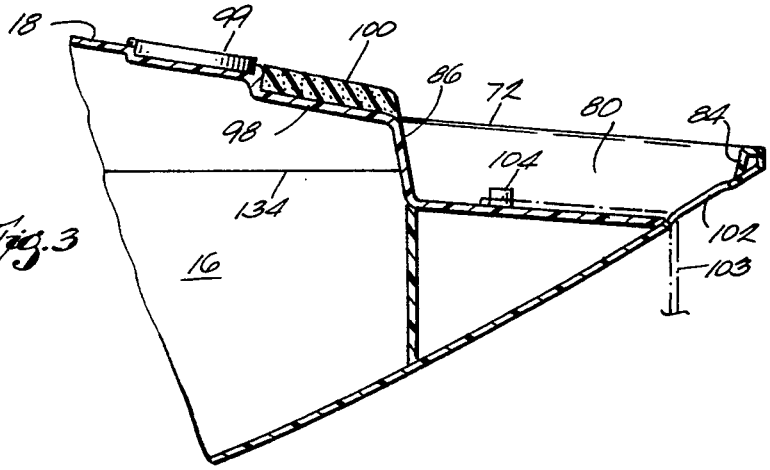
FIG. 3 is a cross-sectional view taken along line 3–3 of FIG. 2.

The forward cockpit is located substantially in front of the cabin 16 in the bow 12 section of the boat. It has a floor 78 which has a top surface 79. The top surface 79 of the floor 78 is below the level of the port side deck 72 or the starboard side deck 74. As seen in FIG. 3, the floor 78 slopes slightly forwardly.

The forward cockpit 76 is further defined by a port side wall 80 and a starboard side wall 82. In one embodiment these side walls join at their forward ends at a junction 84 which is at the forward extreme of the bow 82 of the boat 10. In this embodiment the forward cockpit is roughly pie shaped. The forward cockpit port side wall 80 is adjacent and immediately inboard of the port hull side wall 56. The starboard forward cockpit side wall 82 is adjacent and immediately inboard of the starboard hull side wall 58. The top edge 94 of the port forward cockpit side wall 80 is at the level of the port gunnel 64 or side deck 72. Similarly, the top edge 96 of the starboard forward cockpit side wall 82 is at the level of the starboard gunnel 66 or side deck 74.

The forward cockpit is further defined by a substantially vertical aft wall 86. In one embodiment, the aft wall 86 comprises a central or middle portion 88 and a port side portion 90 and starboard side 92 portion. In one embodiment, the central portion 88 extends forwardly from the port 90 and starboard side 92 side portions. In one embodiment, the central portion 88 extends forwardly in a substantially semi-circular arc.

Immediately behind the central portion 88 of the forward cockpit aft wall 86 is a substantially horizontal or forward sloping forward portion 98 of the cabin top 18. This forward portion 98 extends rearwardly from the top edge of the central portion 88 of the aft wall. In a preferred embodiment, a cushion 100 covers this forward portion 98 of the cabin top 18 and acts as a seating area for the forward cockpit. Centrally located and immediately behind this forward portion 98 is a hatch 99 allowing access into the cabin 16.

In a preferred embodiment, the forward cockpit also comprises an aperture 102 in the junction 84 between the port 80 and starboard 82 side walls. This aperture 102 allows an anchor line 103 to pass through it so that an anchor (not shown) can remain on the exterior of the boat and the anchor line can pass through to a windlass 104 mounted on the floor 78 of the forward cockpit.

The aperture 104 also acts to allow rain water or spray to drain directly from slightly sloping floor. 78 of the forward cockpit 76 to the body of water in which the boat sits.

Figure 7:
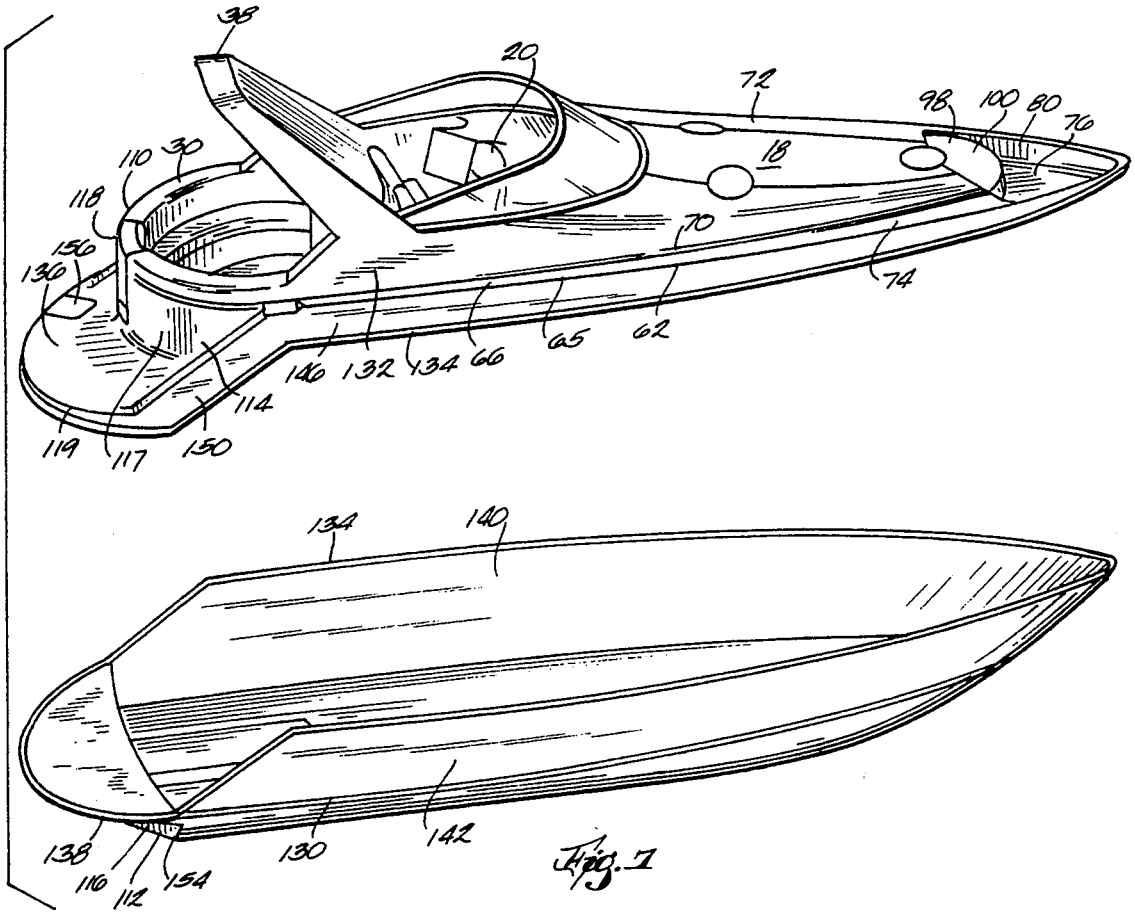
FIG. 7 is a view showing the deck piece separated from the hull piece before assembly.

The boat also comprises a unique transom 110 at the stern 14 or aft area of the boat. As seen in FIGS. 6 and 7, the transom comprises a lower portion 112 and an upper portion 114. The lower portion 112 comprises a substantially vertical transverse wall 116 extending between aft edges of the port bottom section 44 and the starboard bottom section 46 of the hull. In one embodiment the lower portion transverse wall 116 also extends between aft edges of lower portions 140 and 142 of the port hull side wall 56 and the starboard hull side wall 58.

Figure 5:
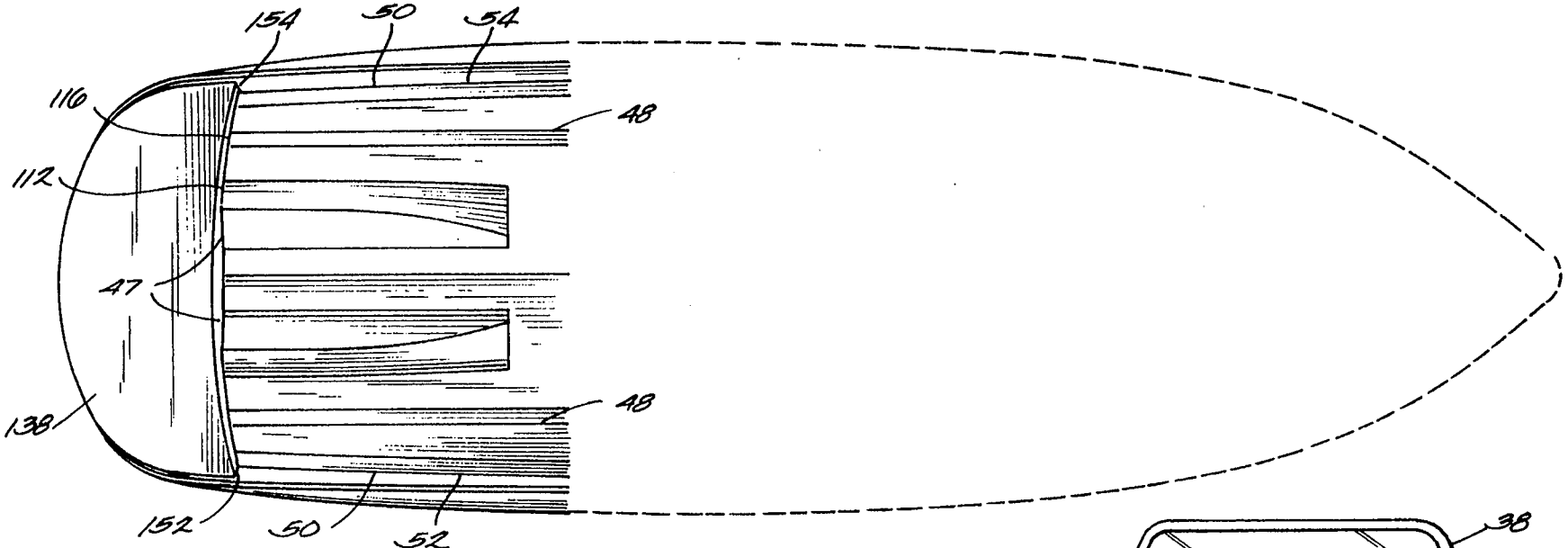
FIG. 5 is a bottom plan view of the aft portion of a boat embodying the invention.

In one embodiment, as seen in FIG. 5, the lower portion transverse wall 116 is bowed slightly outwardly from where it connects the aft edges 152 and 154 lower portions 140 and 142 of the side walls 56 and 58. This creates a very shallow arc as seen in FIG. 5.

Figure 8:
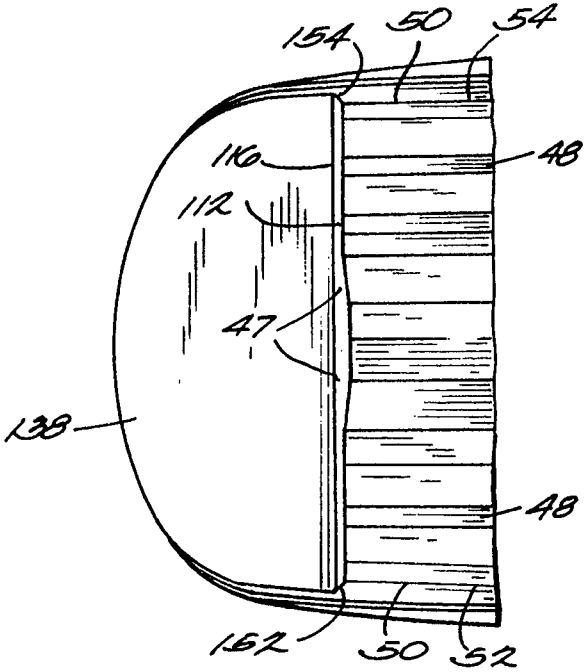
FIG. 8 is a bottom beam view (similar to FIG. 5) of another embodiment of a boat embodying the invention.

In another embodiment, as seen in FIG. 8, the lower portion transverse wall 116 extends in a flat plane between the aft edges 152 and 154.

Figure 9:
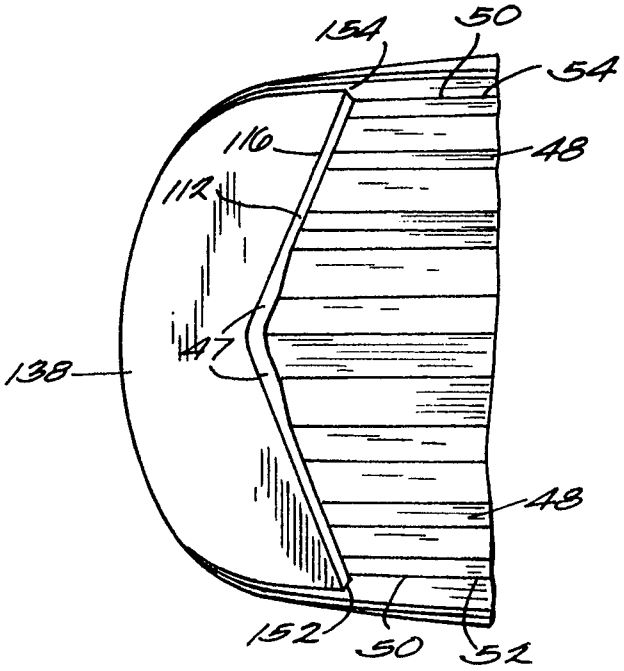
FIG. 9 is a bottom beam view (similar to FIG. 5) of still another embodiment of a boat embodying the invention.

In still another embodiment, as seen in FIG. 9, the lower portion transverse wall 116 projects rearwardly in an outwardly extending V shape with the apex of the V in the middle of the transom.

Any of the shapes shown in FIGS. 6, 8 and 9 is common for a v bottom recreational boat.

The upper portion 114 of the transom is very unique and comprises a substantially vertical wall 117 that extends between the upper and aft portions 144, 146, 148 and 150 of the port 56 and starboard 58 side walls in a substantially semi-circular outward arc. This unique transom gives the boat an aesthetically pleasing appearance which ties into the other curves of the boat.

The transom also comprises a rearwardly extending swim platform 119. The swim platform is located intermediate the lower 112 and upper 114 portions of the transom and extends rearwardly therefrom. The swim platform comprises an upper surface 136 which is integral with a deck piece 132 and a lower surface 138 which is integral with a hull piece 130. The surfaces are joined along a split line 134.

The upper portion of the transom 114 also comprises a transom door 118. The transom door allows access to the swim platform from the aft cockpit 30. As seen in FIG. 6, the transom also comprises a port 120 and starboard 122 set of stairs for climbing from the swim platform to the port 64 or starboard 66 gunnel or side decks 72 or 74. Additionally, on one side of the swim platform upper surface 136 is a door to hide a swim ladder (not shown).

As can be seen in FIG. 7, the boat is constructed primarily of two major pieces, a hull piece 130 and a deck piece 132. The hull piece and the deck piece are mated at a split line 134. The hull piece comprises a major portion of the hull of the boat, including a bottom section having the running surface with the port and starboard bottom sections 44 and 46, as well as the lower transom portion 112 and the lower surface 138 of the swim platform 119.

As can be seen in FIG. 7, the hull port side section 56 and starboard side section 58 are bisected by the split line 134. Accordingly, the hull piece also contains a control section having the bottom portions 140 and 142 of the hull side sections 56 and 58. The deck piece contains the upper portions 144 and 146 and aft portions 148 and 150 of the hull side sections 56 and 58. Accordingly, the deck piece has a port outer depending side section 144 and 148 and a starboard outer depending side section 146 and 150 which depend from the outer edge of the gunnels 64 and 66 to the split line 134.

As can be seen in FIG. 1, the forward cockpit 76 is an indentation in the deck piece 132. The forward cockpit floor 78, aft wall 86 and port 80 and starboard 82 side walls are all unitary in the deck piece 132. Moreover, the aft 86 and port 80 and starboard 82 side walls completely surround the forward cockpit floor except for a small forward opening formed by the aperture 102. The port 80 and starboard 82 side walls nest inside the hull side walls 56 and 58 when the boat is assembled.

Various features in the invention are set forth in the following claims.

I claim:

1. A recreational boat comprising a fiberglass member including an aft cockpit having a semi-circular aft wall, a cabin in front of said aft cockpit, said cabin having a top surface, side walk ways on the port and starboard sides of said cabin, said walk ways having upper surfaces below said cabin top surface, and a forward cockpit having a portion in front of said cabin, and a floor with an upper surface located below said upper surfaces of said walk ways.

2. The boat of claim 1 wherein said cabin has a central front portion and said cabin central front portion extends into said forward cockpit.

3. The boat of claim 2 wherein said central front portion of said cabin has an upper surface and a portion of said upper surface is covered by a cushion.

4. The boat of claim 2 wherein forward cockpit has an aft wall and wherein said front portion of said cabin has a front wall comprising a portion of said aft wall of said forward cockpit.

5. The boat of claim 4 wherein said forward cockpit also has a port side wall and a starboard side wall and said port and starboard side walls meet at the forward extreme of the boat.

6. The boat of claim 5 wherein said forward cockpit is pie-shaped.

7. The boat of claim 6 also having an anchor and an anchor line and wherein said forward cockpit has an aperture at the junction of said side walls of the forward cockpit through which the anchor line passes.

8. The boat of claim 7 also having an anchor line windlass mounted on said floor of said forward cockpit and wherein said anchor line passes from said windlass to said anchor through said aperture.

9. The boat of claim 2 also comprising a hull having a port bottom wall and a starboard bottom wall, said port and starboard bottom walls being in a generally V relationship as seen in transverse cross-section and each of said port and starboard bottom walls having a top edge and an aft edge, port and starboard side walls extending upwardly from said top edges of said port and starboard bottom walls, said port and starboard side walls having aft edges and top edges, said walkways extending inwardly from said side wall top edges, and a transom having a top portion and a bottom portion, said transom bottom portion being substantially vertical and extending transversely between said aft edges of said port and starboard bottom walls, and said transom top portion being substantially vertical and extending transversely in a substantially semi-circular arc between said port and starboard side walls.

10. A boat comprising a hull having port and starboard side walls with each of said walls having a top edge, and a fiberglass deck piece fabricated separately from said hull and comprising an aft cockpit including a floor, a helm station locked forwardly of said aft cockpit, a cabin top and port and starboard cabin side walls located forward of said helm station, a port side deck below said cabin top and between said cabin port side wall and said port hull top edge, a starboard side deck below said cabin top and between said cabin side wall and said starboard hull top edge, and a forward cockpit having a floor below said port and starboard side decks.

11. The boat of claim 10 wherein said cabin has a front wall with a middle portion and said cabin front wall middle portion extends into the forward cockpit.

12. The boat of claim 11 wherein said cabin top has a forward portion and a cushion covering said cabin top forward portion.

13. The boat of claim 12 wherein said forward cockpit has an aft side and said cushion defines a seating area behind a portion of said aft side of said forward cockpit.

14. The boat of claim 10 wherein said forward cockpit also has a port side wall and a starboard side wall and said port and starboard side walls join at the forward extreme of the boat.

15. The boat of claim 14 wherein said forward cockpit is pie-shaped.

16. The boat of claim 14 also having an anchor and an anchor line and said forward cockpit has an aperture at the junction of said side walls of the forward cockpit through which the anchor line passes.

17. The boat of claim 16 also having an anchor line windlass mounted on said floor of said forward cockpit and the anchor line passes from the windlass to the anchor through said aperture.

18. The boat of claim 10 wherein the boat floats on a body of water and said forward cockpit floor also comprises a drain and said drain communicates directly between said forward cockpit and said body of water.

19. A boat comprising a hull having a port side wall and a starboard side wall with each of said side walls having a top edge, said boat also including a raised centrally located helm station, an aft cockpit behind said helm station and including a semi-circular aft wall and a floor below said helm station, a port narrow side deck, a starboard narrow side deck, said narrow side decks being on either side of and below said helm station, inboard of said port and starboardhull top edges, and above said aft cockpit floor, and a forward cockpit having a floor below said side decks and below said hull port and starboard top edges.

20. The boat of claim 19 wherein said forward cockpit also comprises an aft wall, said aft wall having a central portion and port and a starboard side portions, and said aft wall central portion is located forwardly of said aft wall side portions.

21. The boat of claim 20 wherein said forward cockpit aft wall central portion has a top and the boat also has a substantially horizontal wall extending rearwardly from said forward cockpit wall central portion top.

22. The boat of claim 21 also having a cushion mounted on a portion of said horizontal wall.

23. The boat of claim 20 wherein said forward cockpit also has a port side wall and a starboard side wall.

24. The boat of claim 23 wherein said forward cockpit port side wall is immediately adjacent and inboard of said hull port side wall and said forward cockpit starboard side wall is immediately adjacent and inboard of said hull starboard side wall.

25. The boat of claim 23 wherein said boat also includes an anchor and an anchor line, and said forward cockpit has an aperture through which said anchor line passes.

26. The boat of claim 25 also having an anchor line windlass mounted on said floor of said forward cockpit and said anchor line passes from said windlass to said anchor through said aperture.

27. A boat comprising a hull piece, and a fiberglass deck piece fabricated separately from said hull piece and comprising a forward end, an indentation near said forward end and including a floor and peripheral walls completely surrounding said indentation floor, and a substantially horizontal cabin top aft of said indentation and above said indentation floor, said hull and said deck pieces being joined along a split line located above said floor.

28. The boat of claim 27 wherein said boat floats on a body of water and said indentation floor also comprises a drain directly communicating between said indentation to said body of water.

29. The boat of claim 27 wherein said hull piece also comprises a port bottom wall and a starboard bottom wall with said port and starboard bottom walls being in a generally V relationship as seen in transverse cross-section and each of said port and starboard bottom walls having a top edge, and a port side wall and a starboard side wall extending upwardly from said top edges of said port and starboard bottom walls, each of said port and starboard side walls also having a top edge which contacts said deck piece at said split line.

30. The boat of claim 29 wherein said deck piece also comprises port and starboard side walls having respective bottom edges contacting said port and starboard hull side wall top edges at said split line.

31. The boat of claim 27 wherein said deck piece also comprises a helm station and said helm station is aft of and above said cabin top.

32. A boat comprising a hull having a port bottom wall and a starboard bottom wall, said port and starboard bottom walls being in a generally V relationship as seen in transverse cross-section and each of said port and starboard bottom walls having a top edge and an aft edge, port and starboard side walls extending upwardly from said top edges of said port and starboard bottom walls, each of said port and starboard side walls having an aft edge, and a transom wall having a top portion and a bottom portion, said transom wall bottom portion being substantially vertical and extending transversely between said aft edges of said port and starboard bottom walls in a substantially flat configuration, and said transom top portion being substantially vertical and extending transversely in a substantially semi-circular arc between said port and starboard side walls.

33. The boat of claim 32 wherein said bottom portion of said transom wall extends between said aft edges of said port and starboard bottom walls in a plane.

34. A boat comprising a hull having a port bottom wall and a starboard bottom wall, said port and starboard bottom walls being in a generally V relationship as seen in transverse cross-section and each of said port and starboard bottom walls having a top edge and an aft edge, port and starboard side walls extending upwardly from said top edges of said port and starboard bottom walls, each of said port and starboard side walls having an aft edge, and a transom wall having a top portion and a bottom portion, said transom wall bottom portion being substantially vertical and extending transversely between said aft edges of said port and starboard bottom walls in a substantially shallow outwardly bending arc, said transom top portion being substantially vertical and extending transversely in a substantially semi-circular arc between said port and starboard side walls.

35. A boat comprising a hull having a port bottom wall and a starboard bottom wall, said port and starboard bottom walls being in a generally V relationship as seen in transverse cross-section and each of said port and starboard bottom walls having a top edge and an aft edge, port and starboard side walls extending upwardly from said top edges of said port and starboard bottom walls, each of said port and starboard side walls having an aft edge, and a transom wall having a top portion and a bottom portion, said transom wall bottom portion being substantially vertical and extending between said aft edges of said port and starboard bottom walls in an outwardly V shape as seen from above, and said transom top portion being substantially vertical and extending transversely in a substantially semi-circular arc between said port and starboard side walls.

36. A boat comprising a hull having a port bottom wall and a starboard bottom wall, said port and starboard bottom walls being in a generally V relationship as seen in transverse cross-section and each of said port and starboard bottom walls having a top edge and an aft edge, port and starboard side walls extending upwardly from said top edges of said port and starboard bottom walls, each of said port and starboard side walls having an aft edge, a transom wall having a top portion and a bottom portion, said transom wall bottom portion being substantially vertical and extending transversely between said aft edges of said port and starboard bottom walls, and said transom top portion being substantially vertical and extending transversely in a substantially semi-circular arc between said port and starboard side walls, and an aft swim platform extending rearwardly from intermediate said transom top portion and said transom bottom portion.

37. A fiberglass recreational boat comprising a fiberglass hull piece comprising a port bottom wall having an aft edge, a starboard bottom wall having an aft edge, said hull bottom walls being in a generally V relationship as seen in transverse cross section, each of said bottom walls having an aft edge, said hull piece also comprising, and a substantially vertical hull transom wall extending transversely between said bottom wall aft edges, a fiberglass deck piece comprising a port side wall having an aft portion, a starboard side wall having an aft portion, and a substantially vertical deck transom wall extending between said aft portions of said deck side walls in a substantially semicircular arc, said hull piece and said deck piece being joined along a split line.

38. The boat of claim 37 wherein said bottom portion of said transom wall extends between said aft edges of said port and starboard bottom walls in a substantially shallow outwardly bending arc.

39. The boat of claim 38 wherein said bottom portion of said transom wall extends between said aft edges of said port and starboard bottom walls in a plane.

40. The boat of claim 38 wherein said deck piece also has an indentation at its forward end, said indentation having a floor and peripheral walls, with said indentation floor and walls being unitary in said deck piece and said peripheral walls completely surrounding said indentation floor.

41. The boat of claim 38 wherein said deck transom wall also comprises a centrally located door.

42. A boat comprising a hull piece, a deck piece, and a split line, with said hull piece and said deck piece joined at said split line, said hull piece comprising a port and a starboard bottom wall, said hull bottom walls being in a generally V relationship as seen in transverse cross section, each of said bottom walls having an aft edge, said hull piece comprising a substantially vertical hull transom wall extending transversely between said bottom wall aft edges, said deck piece also comprising a port and a starboard side wall with said port and starboard side walls having aft edges, and a substantially vertical deck transom wall including a top portion extending between said deck side walls in a substantially semicircular arc, and a bottom portion extending between said aft edges of said port and starboard bottom walls in an outwardly V shape as seen from above.

43. A boat comprising a hull having port and starboard side walls with each of said walls having a top edge, and a fiberglass deck piece fabricated separately from said hull and comprising an aft cockpit, a raised helm station located forwardly of said aft cockpit, a central cabin located forwardly of said helm station and having a cabin top and port and starboard cabin side walls, a port side deck below said cabin top and between said cabin port side wall and said port hull top edge and including an aft end, a starboard side deck below said cabin top and between said cabin starboard side wall and said starboard hull top edge and including an aft end, a stair extending downwardly from said aft end of one of said side decks, and a forward cockpit located forwardly of said cabin and having a floor below said port and starboard side decks.

44. A boat comprising a hull having port and starboard side walls with each of said walls having a top edge, and a fiberglass deck piece fabricated separately from said hull and comprising an aft cockpit, a horizontally extending platform surface located rearwardly of said aft cockpit, a raised helm station located forwardly of said aft cockpit, a central cabin located forwardly of said helm station and having a cabin top and port and starboard cabin side walls, a port side deck below said cabin top and between said cabin port side wall and said port hull top edge, a starboard side deck below said cabin top and between said cabin starboard side wall and said starboard hull top edge, and a forward cockpit located forwardly of said cabin and having a floor below said port and starboard side decks.

45. A boat comprising a hull having port and starboard side walls with each of said walls having a top edge, and a fiberglass deck piece fabricated separately from said hull and comprising an aft cockpit, a raised helm station located forwardly of said aft cockpit, a central cabin located forwardly of said helm station and including port and starboard cabin side walls and a cabin top having a forward portion, a port side deck below said cabin top and between said cabin port side wall and said port hull top edge, a starboard side deck below said cabin top and between said cabin starboard side wall and said starboard hull top edge, and a forward cockpit located forwardly of said cabin, having a floor below said port and starboard side decks, and having a rearward wall extending vertically between said floor and said forward portion of said cabin top and from said port side deck and said starboard side deck, whereby at least a part of said forward portion of said cabin top provides a seating surface.

46. A boat in accordance with claim 45 including a cushion on said forward portion of said cabin top adjacent said rearward wall of said forward cockpit.

47. A boat in accordance with claim 45 wherein said forward portion of said cabin top includes a forwardmost part, and wherein said forward cockpit has areas located rearwardly of said forwardmost part and in front of each of said port and starboard side decks.

48. A boat in accordance with claim 45 wherein said forward cockpit also has a port sidewall and a starboard sidewall, and said port and starboard sidewalls join at the forward extreme of the boat.

49. A boat comprising a hull having port and starboard side walls with each of said walls having a top edge, and a fiberglass deck piece fabricated separately from said hull and comprising an aft cockpit, a horizontally extending platform surface located rearwardly of said aft cockpit, a raised helm station located forwardly of said aft cockpit, an inverted U-shaped arch extending upwardly and rearwardly from said helm station, a central cabin located forwardly of said helm station and having port and starboard cabin side walls, and a cabin top extending forwardly from said helm station and including a forward portion, a port side deck below said cabin top and between said cabin port side wall and said port hull top edge and including an aft end, a starboard side deck below said cabin top and between said cabin starboard side wall and said starboard hull top edge and including an aft end, a stair extending downwardly from said aft end of one of said side decks, and a forward cockpit located forwardly of said cabin, having a floor below said port and starboard side decks, and having a rearward wall extending vertically between said floor and said forward portion of said cabin top and from said port side deck and said starboard side deck, whereby at least a part of said forward portion of said cabin top provides a seating surface.

* * * * *